United States Patent [19]

Duret

[11] Patent Number: 4,862,689

[45] Date of Patent: Sep. 5, 1989

[54] DEVICE AND METHOD FOR THE RAPID PRIMING OF AN OXIDATION CATALYST FOR A TWO STROKE ENGINE

[75] Inventor: Pierre Duret, Paris, France

[73] Assignee: Institut Francais du Petrole Automobiles Peugeot & Automobiles Citroen, Rueil-Malmaison, France

[21] Appl. No.: 135,227

[22] Filed: Dec. 21, 1987

[30] Foreign Application Priority Data

Dec. 19, 1986 [FR] France ..... 86 18010

[51] Int. Cl.[4] ..... F01N 3/20

[52] U.S. Cl. ..... 60/274; 60/284; 60/288

[58] Field of Search ..... 60/288, 274, 284

[56] References Cited

U.S. PATENT DOCUMENTS 3,440,817 4/1969 Saufferer ..... 60/284

FOREIGN PATENT DOCUMENTS 4825 1/1986 Japan ..... 60/314

61-907 3/1986 Japan ..... 60/288

*Primary Examiner*—Douglas Hart

*Attorney, Agent, or Firm*—Antonelli, Terry & Wands

[57] ABSTRACT

A device and method are provided for rapidly priming a catalyst contained in a catalytic pot for a two stroke engine wherein the hottest fraction of the exhaust gases is transferred upstream of said catalyst and the remaining fraction of the exhaust gases is transferred downstream of said catalyst, as long as said catalyst is not primed.

8 Claims, 1 Drawing Sheet

DEVICE AND METHOD FOR THE RAPID PRIMING OF AN OXIDATION CATALYST FOR A TWO STROKE ENGINE

SUMMARY OF THE INVENTION

The present invention relates to a device and method for rapidly priming an oxidization catalyst for a two stroke engine having at least one cylinder.

The device of the invention uses a separation, in the axial direction of the cylinder, of the exhaust port(s) and pipe(s) for selecting two exhaust gas outlets which at least during certain operating periods or phases of the engine are of different composition and/or temperature.

The outlet whose temperature is the highest may be permanently connected to the oxidation catalyst. The other outlet, in which the temperature of the gases is lower may be connected either directly to the catalyst or to the exhaust pipe downstream of the catalyst, depending respectively on whether the catalyst is primed or not. By primed catalyst is meant the fact that the catalyst has reached a high enough temperature to be sufficiently active.

Thus, the present invention relates to a two stroke engine having at least one cylinder head, a cylinder and a catalytic muffler or pot, said pot comprising a catalyst for treating the exhaust gases, said cylinder having at least two exhaust openings or ports offset with respect to each other in the axial direction of said cylinder.

The device of the invention comprises in combination: a first duct connecting that one of said ports which is closest to the cylinder head, or first port, to a point upstream of said catalyst, a second duct connecting the other port to upstream of said catalyst, a bypass duct connecting a point of said second duct to a point downstream of said catalyst and a distribution member positioned at the junction of the bypass duct with the second duct, said distribution member being adapted for distributing the gas coming from said second port upstream and downstream of said catalyst.

The engine of the invention may include means for controlling said distribution member.

In accordance with the invention, the control means may be driven by means detecting the temperature level of said catalyst.

Without departing from the scope of the present invention, one at least of said first and second exhaust ducts may have means restricting its passage section.

Similarly, still within the scope of the present invention, the first duct may include periodic closure means slaved to the rotational speed of the engine. These means may include a rotary throttle chamber.

The invention also relates to a method of rapidly priming a catalyst contained in a catalytic pot in a two stroke engine, in which the hottest fraction of the exhaust gases is transferred upstream of said catalyst and the remaining fraction of the exhaust gases is transferred downstream of said catalysts, as long as said catalyst is not primed.

Priming of the catalyst may be determined by detecting a magnitude related to the temperature of said catalyst.

BRIEF DESCRIPTION OF THE DRAWINGS

The advantages and characteristics of the invention will be clear from the following description, given by way of non limitative example, with reference to the accompanying Figs. in which.

MORE DETAILED DESCRIPTION OF THE INVENTION

Figure 1:
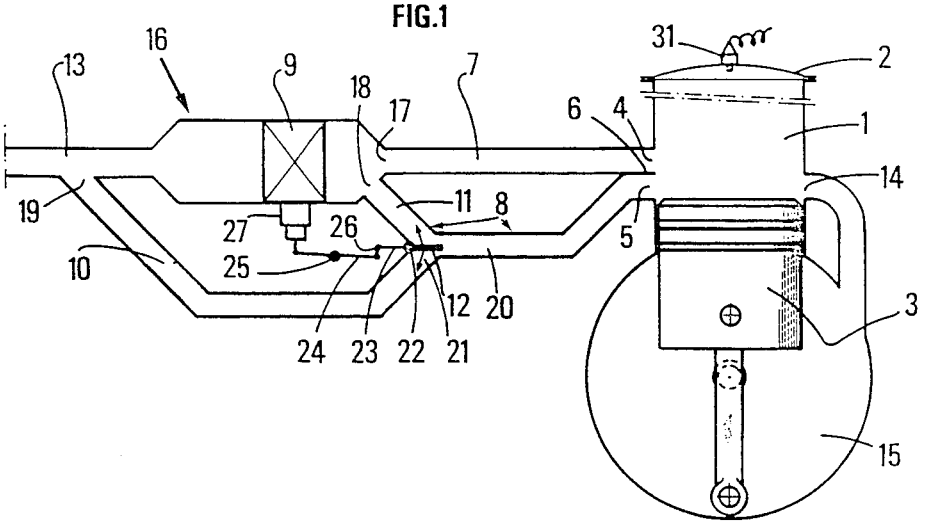
FIG. 1 shows schematically and in section a two stroke engine equipped with a catalytic oxidation pot and the device of the invention.

FIG. 1 is a schematical representation of a cylinder of a two stroke engine with controlled ignition equipped with a catalytic oxidation pot and a device of the invention. Reference 1 designates the cylinder closed at its upper part by the cylinder head 2. Piston 3 moves in the cylinder. Reference 31 designates the spark plug of cylinder 1. This cylinder has two exhaust ports 4 and 5 situated on different sides considering the axis of the cylinder.

One of these ports, which will be termed first exhaust port 4, will be closer to the cylinder head 2 than the other, which will be termed second exhaust port 5. In FIG. 1, these two ports are separated by a dividing wall 6.

Reference 16 designates a catalytic pot containing a catalyst 9.

Reference 7 designates an exhaust pipe or duct placing the first exhaust port 4 in communication with an inlet 17 of the catalytic pot upstream of the catalyst 9.

Reference 8 designates a second exhaust pipe or duct connecting the second exhaust port 5 to an inlet 18 of the catalytic port upstream of the catalyst 9. Without departing from the present invention, the first and second exhaust pipes may join up before emerging into the catalytic pot 16, as is shown with broken lines in FIG. 2.

Reference 10 designates a bypass pipe or duct one of whose ends is connected to the second exhaust pipe 8 forming a tapping. The other end of duct 10 may be connected downstream of catalyst 9, as is shown in FIG. 1. In this Fig., the bypass pipe is connected at 19 to a pipe 13 coming from the catalytic pot 16 downstream of the catalyst. In all cases, this other end of the duct is not connected upstream of catalyst 9.

The bypass pipe provides the second exhaust pipe 8 into two portions, one 20 between the second exhaust port 5 and position 21 at which the bypass pipe 10 is connected, the other 11 being between this connection position 21 and the inlet 18 of the catalytic pot.

Reference 12 designates a member for distributing the gases coming from the second exhaust port 5, such distribution being effected through the first portion 20 of the second exhaust pipe 8. In the case of FIG. 1, this member is a flap 12. This flap makes it possible either to cause the exhaust gas coming from the pipe portion 20 to pass into the catalyst, or not to pass therein, it is this portion 11 of the second exhaust duct 8 which makes it possible to cause these exhaust gases to pass into the catalyst 9.

In FIG. 1, flap 12 is hinged about a shaft 22, and is secured to a control rod 23 which may be placed in its extension. This rod 23 is connected to an arm 24 articulated about a shaft 25 by means of an intermediate articulation piece 26.

The articulated arm 24 is controlled by means of a detector 27 determining whether the catalyst is primed or not. In a preferred embodiment of the invention, this detector is a temperature sensor.

This temperature sensor may be of any known type, in particular with bimetal strip, wax reserve or electronic etc.

Figure 2:
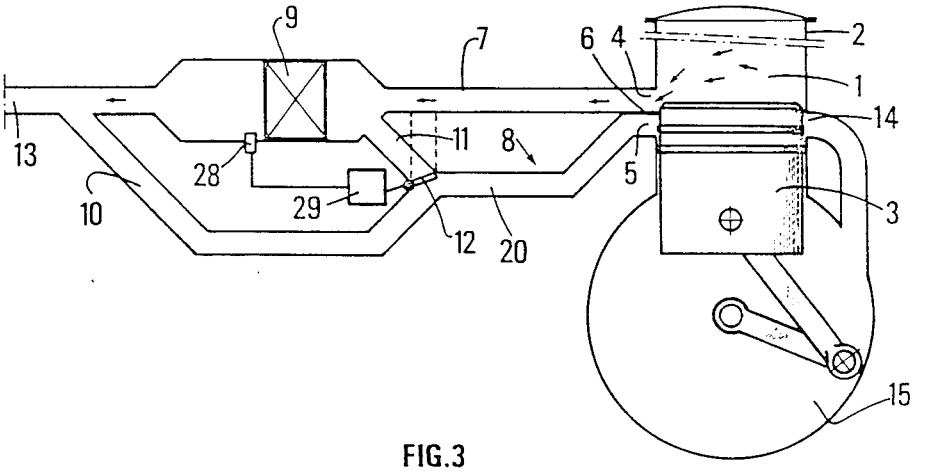
FIGS. 2 and 3 illustrate the operation of the invention and of the device of the invention.
Figure 3:
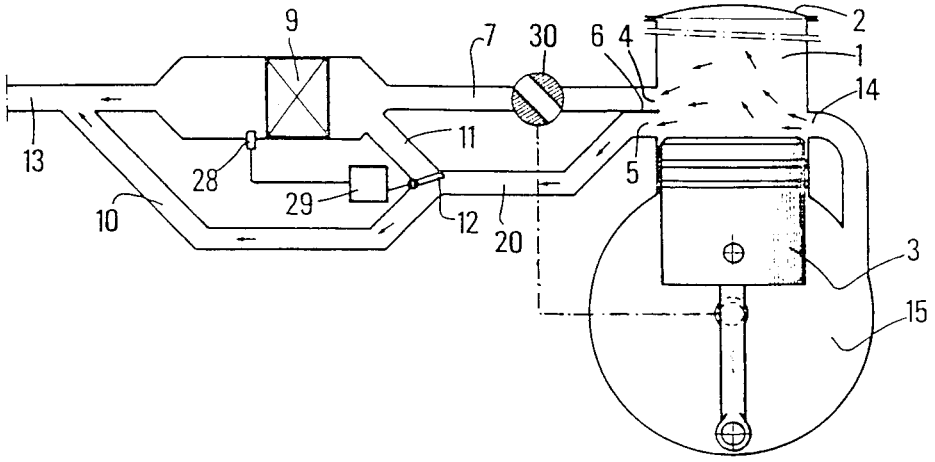

In the case of FIGS. 2 and 3, the detector comprises a temperature sensor whose signal is transmitted to a control box 29 which acts directly on rod 23 controlling flap 12.

The movement of piston 3 causes cylinder 1 and exhaust pipes 7 and 8 to be placed in communication through, respectively, the two stages 4 and 5 of the exhaust port or ports, separated by a dividing wall 6.

Thus, the first pipe is connected directly to a catalytic oxidation pot 9. The second pipe 8 is divided into two parts 10 and 11 which may be alternately closed depending on the position of flap 12. The first portion 20 of pipe 8 may then be connected directly to pipe 13 downstream of catalyst 9 through the bypass pipe 10, or less directly through the second portion 11 of the exhaust pipe 8 and the oxidation catalyst 9, depending on the position occupied by flap 12.

The operation of the engine equipped with the device of FIG. 1 is described hereafter with reference to FIGS. 2 and 3.

At start up, the catalyst is not primed, because when cold flap 12 closes off the second portion 11 of the second exhaust pipe or duct 8.

In the rest of the description, we will consider a complete operating cycle of a cylinder of the engine with reference to the stroke of piston 3. In FIG. 2, piston 3, which is in the expansion phase, uncovers the first exhaust port 4, letting the burnt gases escape, previously enclosed under pressure in the cylinder, into the exhaust pipe 7.

The dividing wall or separation 6 may not be in contact with the piston 3 and only as close as possible thereto so as to minimize the leaks when it is masked by the piston. Such an assembly makes it possible to equip existing engines with the improvement of the invention by obtaining two ports 4 and 5 offset in the direction defined by the axis of the cylinder.

The level of this separation 6 may be preferably chosen at the level of the transfer 14, for example. Pipe 7 is then supplied with very hot burnt gases, whereas pipe 20 is not supplied.

In FIG. 3, all the ports of the cylinder are open, the two exhaust ports 4 and 5 as well as the intake port 14, which may be a transfer port 14 connected to the casing 15 of the engine.

In this case, the contents of cylinder 1 is scavenged by the fresh gases coming from casing 15 through port 14. The present invention is applicable even if the fresh gases come partially or totally from a valve, whether the engine is or not of the crank-case pump type.

Pipe 7 continues to be supplied essentially with burnt gases, which also supply, but to a lesser extent, the second pipe 8 whose port 5 has been opened much later.

With the exhaust ports wide open, a part of the fresh gases also escapes into pipes 7 and 8. The absence of catalyst in the circuit formed by the first portion 20 of pipe 8 and the bypass pipe 10 may take it more permeable, which is rather favorable for rapidly bringing the catalyst up to temperature.

Similarly, the flow in one or other of the two exhaust pipes 7 and 8 may be promoted, by attributing thereto different pressure losses using different means, such as at least a restriction, a butterfly valve, or different pipe diameters, etc.

When piston 3 rises, it first of all closes the second exhaust port, or lower port 5, then the first exhaust port 4, or upper port. The terms upper and lower are to be considered by assuming the cylinder head 2 as being the top of the engine and casing 15 as the bottom of the engine.

In two stroke engines with more or less delayed introduction of fuel with respect to the air, the "short circuiting" of the fuel to the exhaust occurs shortly before closure of the exhaust ports. Thus, in this case the "short circuited" fuel will preferably supply pipe 7. By "short circuiting" or "short circuited" is meant the fact that a part of the fuel passes directly to the exhaust, without participating in the combustion in the cylinder and before such combustion has taken place.

At the time of closing the exhaust and before the beginning of a new scavenging cycle, the burnt and fresh gas compositions in pipes 7 and 8 will then be different because of the device of the invention. In fact, pipe 7 may contain proportionally much more burnt gas and less fresh gas (with possibly more "short circuited" fuel) than pipe 8.

The overall temperature of the gases will then be appreciably greater than that of those of pipe 8.

This higher temperature will be used for making possible the rapid priming of catalyst 9.

Then, when the temperature of catalyst 9 reaches a sufficient level for correct conversion of the polluents discharged by the cylinder, the position of flap 12 is changed so, this time, as to place the first portion 20 of the second exhaust pipe 8 in communication, this latter will convey interalea a fraction of fresh gas and oxygen which are required for a complete conversion of the polluents, in catalyst 9.

In FIG. 1, flap 12 is controlled by means of temperature sensors 27 and the assembly of displacement means 24, 26 and 23. In FIGS. 2 and 3, displacement of flap 12 is caused by control means 29 connected to a temperature sensor 28.

In the preceding example, the first exhaust pipe connected the first exhaust port 4 directly to pot 1.

In a particular embodiment, the exhaust pipe 7 may include a periodic closure member, such as a rotary throttle chamber 30, rotated at a speed equal to or a multiple of the rotational speed of the engine. This throttle chamber is dimensioned and set so that duct 7 is only open for a period corresponding to the presence of hot gas in the cylinder.

Thus, by way of example, it is possible to set this throttle chamber so that the first exhaust pipe is open when piston 3 uncovers the first port 4 and as long as the intake port 14 is not open. Thus, it is certain that the fresh and cold gases will not pass through the catalyst.

Without departing from the scope of the present invention, the temperature sensor 27 or 28 may be replaced by other means for determining whether the catalyst is primed or not.

In addition, it is possible in accordance with the present invention for the distribution flap 12 to occupy intermediate positions progressively as the temperature of the catalyst evolves.

It is obvious that without departing from the scope of the present invention, the engine may have several cylinders with one or more catalytic pots. In this case, one or more cylinders may be equipped with a device of the present invention. The number of cylinders equipped with the device of the invention may be determined as a function of the desired delay in priming the catalyst.

What is claimed is:

1. A two stroke engine having at least one cylinder head, a cylinder and a catalytic muffler or pot, said pot comprising a catalyst for treating the exhaust gases, said cylinder having at least two exhaust openings or ports offset with respect to each other in the axial direction of the cylinder, further comprising in combination: a first duct connecting that one of said ports which is closest to the cylinder head, or first port, to a point upstream of said catalyst, a second duct connecting the other port to upstream of said catalyst, a bypass duct connecting a point of said second duct to a point downstream of said catalyst and a distribution member positioned at the junction of the bypass duct with the second duct, said distribution member being adapted for distributing the gas coming from said second port upstream and downstream of said catalyst.

2. The engine as claimed in claim 1, including means for controlling said distribution member.

3. The engine as claimed in claim 2, wherein said control means are driven by means detecting the temperature level of said catalyst.

4. The device as claimed in one of claims 1 to 3, wherein one at least of said first and second exhaust ducts has means restricting its passage section.

5. The device as claimed in one of claims 1 to 4, wherein said first duct includes periodic closure means slaved to the rotational speed of the engine.

6. The device as claimed in claim 5, wherein said periodic closure member is a rotary throttle chamber.

7. A method of rapidly priming a catalyst contained in a catalytic pot in a two-stroke engine to raise the temperature of the catalyst to a temperature at which the catalyst is active which comprises transferring a hottest fraction of exhaust gases upstream of said catalyst and transferring a remaining fraction of the exhaust gases downstream of said catalyst, as long as said catalyst is not warmed up sufficiently to be active.

8. The method as claimed in claim 7, wherein warming of the catalyst is determined by detecting a magnitude related to the temperature of said catalyst.

* * * * *